US007195706B2

(12) United States Patent
Abernathy et al.

(10) Patent No.: US 7,195,706 B2
(45) **Date of Patent: *Mar. 27, 2007**

(54) FINISHED LUBRICATING COMPRISING LUBRICATING BASE OIL WITH HIGH MONOCYCLOPARAFFINS AND LOW MULTICYCLOPARAFFINS

(75) Inventors: Susan M. Abernathy, Hercules, CA (US); David C. Kramer, San Anselmo, CA (US); John M. Rosenbaum, Richmond, CA (US); Stephen J. Miller, San Francisco, CA (US); Russell R. Krug, Novato, CA (US); James N. Ziemer, Martinez, CA (US); Robert J. Farina, Richmond, CA (US); Mark L. Sztenderowicz, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/743,932

(22) Filed: Dec. 23, 2003

(65) Prior Publication Data

US 2005/0133407 A1 Jun. 23, 2005

(51) Int. Cl.

| | |
|---|---|
| ***C10G 73/38*** | (2006.01) |
| ***C10G 71/00*** | (2006.01) |
| ***C10M 101/00*** | (2006.01) |

(52) U.S. Cl. ..... 208/18; 208/19; 208/27; 208/97; 208/950

(58) Field of Classification Search ..... 208/18, 208/19, 27, 97, 950

See application file for complete search history.

(56) References Cited

U.S. PATENT DOCUMENTS 4,673,487 A * 6/1987 Miller ..... 208/58
5,082,986 A 1/1992 Miller (Continued)

FOREIGN PATENT DOCUMENTS

EP 0 668 342 8/1995

(Continued)

OTHER PUBLICATIONS

"Product Brochure of Shell MDS (Malaysia) Sdn Bhd" dated May 1995.

*Primary Examiner*—Ellen M. McAvoy
(74) *Attorney, Agent, or Firm*—W. Keith Turner; Alan W. Klaassen; Susan M. Abernathy

(57) ABSTRACT

A process for manufacturing a finished lubricant by: a) performing Fischer-Tropsch synthesis on syngas to provide a product stream; b) isolating from said product stream a substantially paraffinic wax feed having less than about 30 ppm total nitrogen and sulfur, and less than about 1 wt % oxygen; c) dewaxing said feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), to produce an isomerized oil; and d) hydrofinishing said isomerized oil, whereby a lubricating base oil is produced having specific desired properties; and e) blending the lubricating base oil with at least one lubricant additive.

30 Claims, 1 Drawing Sheet

U.S. PATENT DOCUMENTS

| | | | |
|---|---|---|---|
| 2003/0088133 | A1 | 5/2003 | O'Rear |
| 2004/0108248 | A1 | 6/2004 | Cody et al. |
| 2004/0108249 | A1 | 6/2004 | Cody et al. |

FOREIGN PATENT DOCUMENTS

| | | |
|---|---|---|
| EP | 0 776 959 | 6/1997 |
| WO | WO 99/20720 | 4/1999 |
| WO | WO 00/14179 | 3/2000 |
| WO | WO 00/14183 | 3/2000 |
| WO | WO 00/14187 | 3/2000 |
| WO | WO01/57166 | 8/2001 |
| WO | WO 02/064710 | 8/2002 |
| WO | WO 02/064711 | 8/2002 |
| WO | WO 02/070636 | 9/2002 |
| WO | WO2004033606 | 4/2004 |
| WO | WO200481157 | 9/2004 |

* cited by examiner

FINISHED LUBRICATING COMPRISING LUBRICATING BASE OIL WITH HIGH MONOCYCLOPARAFFINS AND LOW MULTICYCLOPARAFFINS

FIELD OF THE INVENTION

The invention relates to a process for manufacturing a finished lubricant with the steps of a) performing a Fischer-Tropsch synthesis on syngas to provide a product stream; b) isolating from said product stream a substantially paraffinic wax feed having less than about 30 ppm total combined nitrogen and sulfur, and less than about 1 wt % oxygen; c) dewaxing said substantially paraffinic wax feed by hydroisomerization dewaxing using a shape selective intermediate pore size molecular sieve with a noble metal hydrogenation component wherein the hydroisomerization temperature is between about 600° F. (315° C.) and about 750° F. (399° C.), whereby an isomerized oil is produced; d) hydrofinishing said isomerized oil, whereby a lubricating base oil is produced having: a low weight percent of all molecules with at least one aromatic function, a high weight percent of all molecules with at least one cycloparaffin function, and a high ratio of weight percent of molecules containing monocycloparaffins to weight percent of molecules containing multicycloparaffins; and e) blending the lubricating base oil with at least one lubricant additive.

The invention also relates to the composition and use of the finished lubricants produced by the process disclosed herein. The process manufactures finished lubricants with excellent oxidation stability, low wear, high viscosity index, low volatility, good low temperature properties, and good additive solubility and good elastomer compatibility. The finished lubricants meet the specifications for a wide variety of finished lubricants, including multigrade engine oils and automatic transmission fluids.

BACKGROUND OF THE INVENTION

Finished lubricants and greases used for various applications, including automobiles, diesel engines, natural gas engines, axles, transmissions, and industrial applications consist of two general components, lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Numerous governing organizations, including original equipment manufacturers (OEM's), the American Petroleum Institute (API), Association des Consructeurs d' Automobiles (ACEA), the American Society of Testing and Materials (ASTM), the Society of Automotive Engineers (SAE), and National Lubricating Grease Institute (NLGI) among others, define the specifications for lubricating base oils and finished lubricants. Increasingly, the specifications for finished lubricants are calling for products with excellent low temperature properties, high oxidation stability, low volatility, and good additive solubility and elastomer compatibility. Currently only a small fraction of the base oils manufactured today are able to meet the demanding specifications of premium lubricant products.

Finished lubricants comprising highly saturated lubricating base oils in the prior art have either had very low levels of cycloparaffins; or when cycloparaffins were present, a significant amount of the cycloparaffins were multicycloparaffins. A certain amount of cycloparaffins are desired in lubricating base oils and finished lubricants to provide additive solubility and elastomer compatibility. Multicycloparaffins are less desired than monocycloparaffins, because they decrease viscosity index, lower oxidation stability, and increase Noack volatility.

Examples of highly saturated lubricating base oils having very low levels of cycloparaffins are polyalphaolefins and GTL base oils made from Fischer-Tropsch processes such as described in EPA1114124, EPA1114127, EPA1114131, EPA776959, EPA668342, and EPA1029029. Lubricating base oils in the prior art with high cycloparaffins made from Fischer-Tropsch wax (GTL base oils) have been described in WO 02/064710. The examples of the base oils in WO 02/064710 had very low pour points, between 10 and 40 weight percent cycloparaffins, and the ratio of monocycloparaffins to multicycloparaffins was less than 15. The viscosity indexes of the lubricating base oils in WO 02/064710 were below 140. The Noack volatilities were between 6 and 14 weight percent. The lubricating base oils in WO 02/064710 were heavily dewaxed to achieve low pour points, which would produce reduced yields compared to oils that were not as heavily dewaxed.

The wax feed used to make the base oils in WO 02/064710 had a weight ratio of compounds having at least 60 or more carbon atoms and compounds having at least 30 carbon atoms greater than 0.20. These wax feeds are not as plentiful as feeds with lower weight ratios of compounds having at least 60 or more carbon atoms and compounds having at least 30 carbon atoms. The process in WO 02/064710 required an initial hydrocracking/hydroisomerizing of the wax feed, followed by a substantial pour reducing step. Lubricating base oil yield losses occurred at each of these two steps. To demonstrate this, in example 1 of WO 02/064710 the conversion of compounds boiling above 370° C. to compounds boiling below 370° C. was 55 wt % in the hydrocracking/hydroisomerization step alone. The subsequent pour reducing step would reduce the yield of products boiling above 370° C. further. Compounds boiling below 370° C. (700° F.) are typically not recovered as lubricating base oils due to their low viscosity. Because of the yield losses due to high conversions the process requires feeds with a high ratio of compounds having at least 60 or more carbon atoms and compounds having at least 30 carbon atoms.

Finished lubricants containing GTL base oils with high weight percents of all molecules with at least one cycloparaffin function made from Fischer-Tropsch wax are described in WO 02/064711 and WO 02/070636. Both of these applications use the base oils taught in WO 02/064710, which are not optimal in that they have a ratio of monocycloparaffins to multicycloparaffins less than 15, viscosity indexes less than 140, and may have aromatics contents greater than 0.30 weight percent. WO 02/064711 teaches a 0W-XX grade engine oil and WO 02/070636 teaches an automatic transmission fluid. The 0W-XX grade engine oil of Example 3 in WO 02/064711 is made with a lubricating base oil having a ratio of monocycloparaffins to multicycloparaffins of 13, a viscosity index of 125, and it contains a fairly high level of viscosity index improver, 10.56 weight percent. The automatic transmission fluid of Example 6 in WO 02/070636 is made with a lubricating base oil having 0.8 weight percent aromatics and a viscosity index of 122.

Due to their high saturates content and low levels of cycloparaffins, lubricating base oils made from most Fischer-Tropsch processes or polyalphaolefins may exhibit poor additive solubility. Additives used to make finished lubricants typically have polar functionality; therefore, they may be insoluble or only slightly soluble in the lubricating base oil. To address the problem of poor additive solubility in highly saturated lubricating base oils with low levels of cycloparaffins, various co-solvents, such as synthetic esters, are currently used. However, these synthetic esters are very expensive, and thus, the finished lubricants blended with the lubricating base oils containing synthetic esters (which have acceptable additive solubility) are also expensive. The high price of these finished lubricants limits the current use of highly saturated lubricating base oils with low levels of cycloparaffins to specialized and small markets.

It has been taught in U.S. Patent Application 20030088133 that blends of lubricating base oils composed of 1) alkylated cycloparaffins with 2) highly paraffinic Fischer-Tropsch derived lubricating base oils improves the additive solubility of the highly paraffinic Fischer-Tropsch derived lubricating base oils. The lubricating base oils composed of alkylated cycloparaffins used in the blends of this application are very likely to also contain high levels of aromatics (greater than 30 weight percent), such that the resulting blends with Fischer-Tropsch derived lubricating base oils will contain aromatics at levels greater than 0.30 weight percent. The high level of aromatics will cause reduced viscosity index and oxidation stability.

What is desired are finished lubricants; comprising lubricating base oils with very low amounts of aromatics, high amounts of monocycloparaffins, and little or no multicycloparaffins, that have a moderately low pour point such that they may be produced in high yield and provide good additive solubility and elastomer compatibility. Finished lubricants with these qualities that also have excellent oxidation stability, low wear, high viscosity index, low volatility, and good low temperature properties are also desired. The finished lubricants should meet the specifications for a wide variety of modern lubricant specifications, including multigrade engine oils and automatic transmission fluids. The present invention provides these finished lubricants and the process to make them.

SUMMARY OF THE INVENTION

The present invention is directed to a process for manufacturing a finished lubricant with the steps of: a) performing a Fischer-Tropsch synthesis on syngas to provide a product stream; b) isolating from said product stream a substantially paraffinic wax feed having less than about 30 ppm total combined nitrogen and sulfur, and less than about 1 wt % oxygen; c) dewaxing said substantially paraffinic wax feed by hydroisomerization dewaxing using a shape selective intermediate pore size molecular sieve with a noble metal hydrogenation component wherein the hydroisomerization temperature is between about 600° F. (315° C.) and about 750° F. (399° C.), whereby an isomerized oil is produced; d) hydrofinishing said isomerized oil, whereby a lubricating base oil is produced having: a weight percent of all molecules with at least one aromatic function less than 0.30, a weight percent of all molecules with at least one cycloparaffin function greater than 10, and a ratio of weight percent molecules containing monocycloparaffins to weight percent molecules containing multicycloparaffins greater than 15; and e) blending the lubricating base oil with at least one lubricant additive.

The present invention is also directed to a process for manufacturing a finished lubricant with the steps of: a) performing a Fischer-Tropsch synthesis on syngas to provide a product stream; b) isolating from said product stream a substantially paraffinic wax feed having less than about 30 ppm total combined nitrogen and sulfur, and less than about 1 wt % oxygen; c) dewaxing said substantially paraffinic wax feed by hydroisomerization dewaxing using a shape selective intermediate pore size molecular sieve with a noble metal hydrogenation component wherein the hydroisomerization temperature is between about 600° F. (315° C.) and about 750° F. (399° C.), whereby an isomerized oil is produced; d) hydrofinishing said isomerized oil, whereby a lubricating base oil is produced having: a weight percent of all molecules with at least one aromatic function less than 0.30, a weight percent of all molecules with at least one cycloparaffin function greater than the kinematic viscosity at 100° C. in cSt multiplied by three, and a ratio of weight percent molecules containing monocycloparaffins to weight percent molecules containing multicycloparaffins greater than 15; and e) blending the lubricating base oil with at least one lubricant additive.

The present invention is also directed to a composition of finished lubricant which comprises a lubricating base oil having a weight percent of all molecules with at least one aromatic function less than 0.30, a weight percent of all molecules with at least one cycloparaffin function greater than 10, and a ratio of weight percent molecules containing monocycloparaffins to weight percent molecules containing multicycloparaffins greater than 15; and at least one lubricant additive. In addition, the present invention is directed to a composition of finished lubricant which comprises a lubricating base oil having a weight percent of all molecules with at least one aromatic function less than 0.30, a weight percent of all molecules with at least one cycloparaffin function greater than the kinematic viscosity at 100° C. in cSt multiplied by three, and a ratio of weight percent molecules containing monocycloparaffins to weight percent molecules containing multicycloparaffins greater than 15; and at least one lubricant additive.

The present invention is also directed to a finished lubricant made by the process comprising the steps of: a) performing a Fischer-Tropsch synthesis on syngas to provide a product stream; b) isolating from said product stream a substantially paraffinic wax feed having less than about 30 ppm total combined nitrogen and sulfur, and less than about 1 wt % oxygen; c) dewaxing said substantially paraffinic wax feed by hydroisomerization dewaxing using a shape selective intermediate pore size molecular sieve with a noble metal hydrogenation component wherein the hydroisomerization temperature is between about 600° F. (315° C.) and about 750° F. (399° C.), whereby an isomerized oil is produced; d) hydrofinishing said isomerized oil, whereby a lubricating base oil is produced, and e) blending the lubricating base oil with at least one lubricant additive.

The present invention is also directed to the use of a finished lubricant comprising: a) a lubricating base oil having a weight percent of all molecules with at least one aromatic function less than 0.30, a weight percent of all molecules with at least one cycloparaffin function greater than 10, and a ratio of weight percent of molecules containing monocycloparaffins to weight percent of molecules containing multicycloparaffins greater than 15, and b) a least one lubricant additive; as an engine oil, an automatic transmission fluid, a heavy duty transmission fluid, a power steering fluid, or an industrial gear oil. In another embodiment the present invention is directed to the use of a finished lubricant comprising: a) a lubricating base oil having a weight percent of all molecules with at least one aromatic function less than 0.30, a weight percent of all molecules with at least one cycloparaffin function greater than the kinematic viscosity at 100° C. in cSt multiplied by three, and a ratio of weight percent of molecules containing monocycloparaffins to weight percent of molecules containing multicycloparaffins greater than 15, and b) a least one lubricant additive; as an engine oil, an automatic transmission fluid, a heavy duty transmission fluid, a power steering fluid, or an industrial gear oil.

Using the process of the invention, finished lubricants are prepared which have excellent oxidation stability, low wear, high viscosity index, low volatility, good low temperature properties, good additive solubility, and good elastomer compatibility. The finished lubricants of the present invention may be used in a wide variety of applications and include, for example, automatic transmission fluids and multigrade engine oils.

Because the lubricating base oils have excellent additive stability and elastomer compatibility, finished lubricants may be formulated with little or no ester co-solvent. Because the lubricating base oils have such high viscosity indexes finished lubricants may be formulated using them with little or no viscosity index improver. In preferred embodiments the finished lubricants will produce low levels of wear, and will require lower amounts of antiwear additives.

The very low weight percent of all molecules with at least one aromatic function in the lubricating base oil used to make the finished lubricant of this invention provides excellent oxidation stability and high viscosity index. The high weight percent of all molecules with at least one cycloparaffin function provides improved additive solubility and elastomer compatibility to the lubricating base oil, and to the finished lubricant comprising it. The very high ratio of weight percent of molecules containing monocycloparaffins to weight percent of molecules containing multicycloparaffins (or high monocycloparaffins and little to no multicycloparaffins) optimizes the composition of the cycloparaffins in the lubricating base oil and finished lubricant. Multicycloparaffins are less desired as they dramatically reduce the viscosity index, oxidation stability, and Noack volatility.

Figure 1:
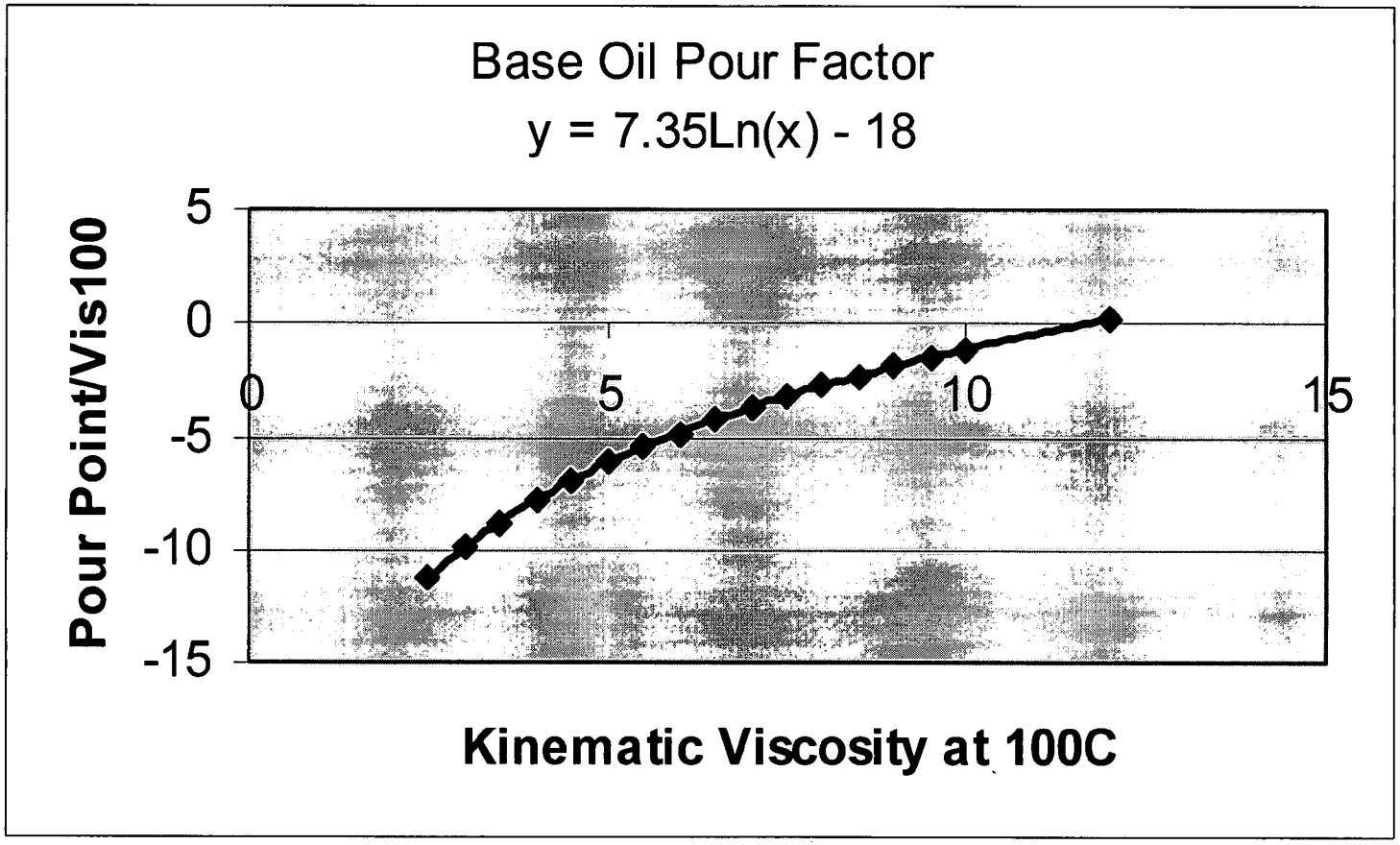
FIG. 1 illustrates the plot of Kinematic Viscosity at 100° C. in cSt vs. Pour Point in degrees Celsius/Kinematic Viscosity at 100° C. in cSt providing the equation for calculation of the Base Oil Pour Factor.

$$\text{Base Oil Pour Factor} = 7.35 \times Ln(\text{Kinematic Viscosity at } 100^\circ\text{ C.}) - 18,$$

wherein Ln(Kinematic Viscosity at 100° C.) is the natural logarithm with base "e" of Kinematic Viscosity at 100° C. in cSt.

DETAILED DESCRIPTION OF THE INVENTION

Finished lubricants comprise a lubricant base oil and at least one additive. Lubricant base oils are the most important component of finished lubricants, generally comprising greater than 70% of the finished lubricants. Finished lubricants may be used in automobiles, diesel engines, axles, transmissions, and industrial applications. Finished lubricants must meet the specifications for their intended application as defined by the concerned governing organization.

Additives which may be blended with the lubricant base oil of the present invention, to provide a finished lubricant composition, include those which are intended to improve select properties of the finished lubricant. Typical additives include, for example, anti-wear additives, EP agents, detergents, dispersants, antioxidants, pour point depressants, viscosity index improvers, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, and the like.

Typically, the total amount of additives in the finished lubricant will be approximately 0.1 to about 30 weight percent of the finished lubricant. However, since the lubricating base oils of the present invention have excellent properties including excellent oxidation stability, low wear, high viscosity index, low volatility, good low temperature properties, good additive solubility, and good elastomer compatibility, a lower amount of additives may be required to meet the specifications for the finished lubricant than is typically required with base oils made by other processes. The use of additives in formulating finished lubricants is well documented in the literature and well known to those of skill in the art.

Finished lubricants containing lubricating base oils with very low aromatic content made prior to this invention have either been formulated with lubricating base oils with very low cycloparaffin content, or with lubricating base oils that had high cycloparaffin content with considerable levels of multicycloparaffins and/or very low pour points. The highest known ratio of monocycloparaffins to multicycloparaffins in lubricating base oils containing greater than 10 weight percent cycloparaffins and low aromatics content prior to this invention; was 13:1. The lubricating base oil with this high ratio was the base oil Example 3 from WO 02/064710. The pour point of this example base oil was extremely low, −45° C., indicating that it was severely dewaxed. Severe dewaxing of base oils to low pour points are made at a significant yield disadvantage compared to lubricating base oils dewaxed to more moderate pour points. This base oil only had a viscosity index of 125. This base oil was used in a 0W-30 engine oil, Example 3 in WO 02/064711.

Lubricating base oils and finished lubricants containing high weight percents of all molecules with at least one cycloparaffin function are desired as cycloparaffins impart additive solubility and elastomer compatibility to these products. Lubricating base oils containing very high ratios of weight percent of molecules containing monocycloparaffins to weight percent of molecules containing multicycloparaffins (or high monocycloparaffins and little to no multicycloparaffins) are also desired as the multicycloparaffins reduce oxidation stability, lower viscosity index, and increase Noack volatility. Models of the effects of multicycloparaffins are given in V. J. Gatto, et al, "The Influence of Chemical Structure on the Physical Properties and Antioxidant Response of Hydrocracked Base Stocks and Polyalphaolefins," J. Synthetic Lubrication 19-1, April 2002, pp 3–18.

By virtue of the present invention, finished lubricants are made which have excellent oxidation stability, low wear, high viscosity index, low volatility, good low temperature properties, good additive solubility, and good elastomer compatibility. These finished lubricants may be obtained using a process comprising the steps of: a) performing a Fischer-Tropsch synthesis on syngas to provide a product stream; b) isolating from said product stream a substantially paraffinic wax feed having less than about 30 ppm total combined nitrogen and sulfur, and less than about 1 wt % oxygen; c) dewaxing said substantially paraffinic wax feed by hydroisomerization dewaxing using a shape selective intermediate pore size molecular sieve with a noble metal hydrogenation component wherein the hydroisomerization temperature is between about 600° F. (315° C.) and about 750° F. (399° C.), whereby an isomerized oil is produced; d) hydrofinishing said isomerized oil, whereby a lubricating base oil is produced having: a weight percent of all molecules with at least one aromatic function less than 0.30, a weight percent of all molecules with at least one cycloparaffin function greater than 10, and a high ratio of weight percent of molecules containing monocycloparaffins to weight percent of molecules containing multicycloparaffins (greater than 15); and e) blending the lubricating base oil with at least one lubricant additive.

Alternatively, step d) of the above process may be changed to: d) hydrofinishing said isomerized oil, whereby a lubricating base oil is produced having: a weight percent of all molecules with at least one aromatic function less than 0.30, a weight percent of all molecules with at least one cycloparaffin function greater than the kinematic viscosity at 100° C. in cSt multiplied by three, and a ratio of weight percent of molecules containing monocycloparaffins to weight percent of molecules containing multicycloparaffins greater than 15.

Kinematic viscosity is a measurement of the resistance to flow of a fluid under gravity. Many lubricating base oils, finished lubricants made from them, and the correct operation of equipment depends upon the appropriate viscosity of the fluid being used. Kinematic viscosity is determined by ASTM D 445-01. The results are reported in centistokes (cSt). The kinematic viscosities of the lubricating base oils of this invention are between about 2 cSt and about 20 cSt, preferably between about 2 cSt and about 12 cSt.

Pour point is a measurement of the temperature at which the sample will begin to flow under carefully controlled conditions. Pour point may be determined as described in ASTM D 5950-02. The results are reported in degrees Celsius. Many commercial lubricating base oils have specifications for pour point. When lubricant base oils have low pour points, they also are likely to have other good low temperature properties, such as low cloud point, low cold filter plugging point, low Brookfield viscosity, and low temperature cranking viscosity. Cloud point is a measurement complementary to the pour point, and is expressed as a temperature at which a sample of the lubricant base oil begins to develop a haze under carefully specified conditions. Cloud point may be determined by, for example, ASTM D 5773-95. Lubricating base oils having pour-cloud point spreads below about 35° C. are also desirable. Higher pour-cloud point spreads require processing the lubricating base oil to very low pour points in order to meet cloud point specifications. The pour-cloud point spreads of the lubricating base oils of this invention are generally less than about 35° C., preferably less than about 25° C., more preferably less than about 10° C. The cloud points are generally in the range of +30 to −30° C.

Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe, and SAE J300-01 and ILSAC GF-3 in North America. Any new lubricating base oil developed for use in automotive engine oils should have a Noack volatility no greater than current conventional Group I or Group II Light Neutral oils. The Noack volatility of the lubricating base oils of this invention are very low, generally less than an amount calculated by the equation:

$$\text{Noack Volatility, Wt \%} = 1000 \times (\text{Kinematic Viscosity at } 100^\circ\text{ C.})^{-2.7}.$$

In preferred embodiments the Noack volatility is less than an amount calculated by the equation:

$$\text{Noack Volatility, Wt \%} = 900 \times (\text{Kinematic Viscosity at } 100^\circ\text{ C.})^{-2.8}.$$

Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) by ASTM D-6375-99. TGA Noack volatility is used throughout this disclosure unless otherwise stated.

The finished lubricants of this invention may be blended with other base oils to improve or modify their properties (e.g., viscosity index, oxidation stability, pour point, sulfur content, traction coefficient, or Noack volatility). Examples of base oils that may be blended with the lubricating base oils of this invention are conventional Group I base oils, conventional Group II base oils, conventional Group III base oils, other GTL base oils, isomerized petroleum wax, polyalphaolefins, polyinternalolefins, oligomerized olefins from Fischer-Tropsch derived feed, diesters, polyol esters, phosphate esters, alkylated aromatics, alkylated cycloparaffins, and mixtures thereof.

Wax Feed:

The wax feed used to make the lubricating base oil of this invention is substantially paraffinic with less than about 30 ppm total combined nitrogen and sulfur. The level of oxygen is less than about 1 weight percent, preferably less than 0.6 weight percent, more preferably less than 0.2 weight percent. In most cases, the level of oxygen in the substantially paraffinic wax feed will be between 0.01 and 0.90 weight percent. The oil content of the feed is less than 10 weight percent as determined by ASTM D 721. Substantially paraffinic for the purpose of this invention is defined as having greater than about 75 mass percent normal paraffin by gas chromatographic analysis by ASTM D 5442.

Nitrogen Determination: Nitrogen is measured by melting the substantially paraffinic wax feed prior to oxidative combustion and chemiluminescence detection by ASTM D 4629-96. The test method is further described in U.S. Pat. No. 6,503,956, incorporated herein in its entirety.

Sulfur Determination: Sulfur is measured by melting the substantially paraffinic wax feed prior to ultraviolet fluorescence by ASTM 5453-00. The test method is further described in U.S. Pat. No. 6,503,956.

Oxygen Determination: Oxygen is measured by neutron activation analysis according to ASTM E385-90(2002).

The wax feed useful in this invention has a significant fraction with a boiling point greater than 650° F. The T90 boiling points of the wax feed by ASTM D 6352 are preferably between 660° F. and 1200° F., more preferably between 900° F. and 1200° F., most preferably between 1000° F. and 1200° F. T90 refers to the temperature at which 90 weight percent of the feed has a lower boiling point.

The wax feed preferably has a weight ratio of molecules of at least 60 carbons to molecules of at least 30 carbons less than 0.18. The weight ratio of molecules of at least 60 carbons to molecules of at least 30 carbons is determined by:

1) measuring the boiling point distribution of the Fischer-Tropsch wax by simulated distillation using ASTM D 6352; 2) converting the boiling points to percent weight distribution by carbon number, using the boiling points of n-paraffins published in Table 1 of ASTM D 6352-98; 3) summing the weight percents of products of carbon number 30 or greater; 4) summing the weight percents of products of carbon number 60 or greater; 5) dividing the sum of weight percents of products of carbon number 60 or greater by the sum of weight percents of products of carbon number 30 or greater. Other preferred embodiments of this invention use Fischer-Tropsch wax having a weight ratio of molecules having at least 60 carbons to molecules having at least 30 carbons less than 0.15, or less than 0.10.

The boiling range distribution of the wax feed useful in the process of this invention may vary considerably. For example the difference between the T90 and T10 boiling points, determined by ASTM D 6352, may be greater than 95° C., greater than 160° C., greater than 200° C., or even greater than 225° C.

Fischer-Tropsch Synthesis and Fischer-Tropsch Wax

The wax feed for this process is preferably Fischer-Tropsch wax produced from Fischer-Tropsch synthesis. During Fischer-Tropsch synthesis liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (about 150 degrees to about 370 degrees C.) preferably from about 400 degrees to about 550 degrees F. (about 205 degrees to about 230 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products from the Fischer-Tropsch synthesis may range from $C_1$ to $C_{200}$ plus hydrocarbons, with a majority in the $C_5$–$C_{100}$ plus range. Fischer-Tropsch synthesis may be viewed as a polymerization reaction. Applying polymerization kinetics, a simple one parameter equation can describe the entire product distribution, referred to as the Anderson-Shultz-Flory (ASF) distribution:

$$W_n=(1-\alpha)^2\times n\times\alpha^{n-1}$$

Where $W_n$ is the weight fraction of product with carbon number n, and $\alpha$ is the ASF chain growth probability. The higher the value of $\alpha$, the longer the average chain length. The ASF chain growth probability of the $C_{20}$+ fraction of the Fischer-Tropsch wax of this invention is between about 0.85 and about 0.915.

The Fischer-Tropsch reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania, or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Hydroisomerization Dewaxing

According to the present invention, the substantially paraffinic wax feed is dewaxed by hydroisomerization dewaxing at conditions sufficient to produce lubricating base oil with a desired composition of cycloparaffins and a moderate pour point. In general, conditions for hydroisomerization dewaxing in the present invention are controlled such that the conversion of the compounds boiling above about 700° F. in the wax feed to compounds boiling below about 700° F. is maintained between about 10 wt % and 50 wt %, preferably between 15 wt % and 45 wt %. Hydroisomerization dewaxing is intended to improve the cold flow properties of a lubricating base oil by the selective addition of branching into the molecular structure. Hydroisomerization dewaxing ideally will achieve high conversion levels of waxy feed to non-waxy iso-paraffins while at the same time minimizing the conversion by cracking.

Hydroisomerization is conducted using a shape selective intermediate pore size molecular sieve. Hydroisomerization catalysts useful in the present invention comprise a shape selective intermediate pore size molecular sieve and a catalytically active metal hydrogenation component on a refractory oxide support. The phrase "intermediate pore size," as used herein means a crystallographic free diameter in the range of from about 3.9 to about 7.1 Angstrom when the porous inorganic oxide is in the calcined form. The shape selective intermediate pore size molecular sieves used in the practice of the present invention are generally 1-D 10-, 11- or 12-ring molecular sieves. The most preferred molecular sieves of the invention are of the 1-D 10-ring variety, where 10-(or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization dewaxing are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization dewaxing are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Angstrom, having a maximum crystallographic free diameter of not more than 7.1 and a minimum crystallographic free diameter of not less than 3.9 Angstrom. Preferably the maximum crystallographic free diameter is not more than 7.1 and the minimum crystallographic free diameter is not less than 4.0 Angstrom. Most preferably the maximum crystallographic free diameter is not more than 6.5 and the minimum crystallographic free diameter is not less than 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10–15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes (p/po=0.5; 25° C.). Intermediate pore size molecular sieves will typically admit molecules having kinetic diameters of 5.3 to 6.5 Angstrom with little hindrance.

Preferred hydroisomerization dewaxing catalysts useful in the present invention have sufficient acidity so that 0.5 grams thereof when positioned in a tube reactor converts at least 50% of hexadecane at 370° C., pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

Hydroisomerization dewaxing catalysts useful in the present invention comprise a catalytically active hydrogenation noble metal. The presence of a catalytically active hydrogenation metal leads to product improvement, especially viscosity index and stability. The noble metals platinum and palladium are especially preferred, with platinum most especially preferred. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support may be selected from those oxide supports which are conventionally used for catalysts, including silica, alumina, silica-alumina, magnesia, titania, and combinations thereof.

The conditions for hydroisomerization dewaxing depend on the feed used, the catalyst used, whether or not the catalyst is sulfided, the desired yield, and the desired properties of the lubricant base oil. Conditions under which the hydroisomerization process of the current invention may be carried out include temperatures from about 600° F. to about 750° F. (315° C. to about 399° C.), preferably about 600° F. to about 700° F. (315° C. to about 371° C.); and pressures from about 15 to 3000 psig, preferably 100 to 2500 psig. The hydroisomerization dewaxing pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 hr-1, preferably from about 0.1 to about 5 hr-1. The hydrogen to hydrocarbon ratio falls within a range from about 1.0 to about 50 moles $H_2$ per mole hydrocarbon, more preferably from about 10 to about 20 moles $H_2$ per mole hydrocarbon. Suitable conditions for performing hydroisomerization are described in U.S. Pat. Nos. 5,282,958 and 5,135,638, the contents of which are incorporated by reference in their entirety.

Hydrogen is present in the reaction zone during the hydroisomerization dewaxing process, typically in a hydrogen to feed ratio from about 0.5 to 30 MSCF/bbl (thousand standard cubic feet per barrel), preferably from about 1 to about 10 MSCF/bbl. Generally, hydrogen will be separated from the product and recycled to the reaction zone.

Hydrotreating and Hydrofinishing

Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated. Waxy feed to the process of this invention is preferably hydrotreated prior to hydroisomerization dewaxing.

Catalysts used in carrying out hydrotreating operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300 degrees F. to about 750 degrees F. (about 150 degrees C. to about 400 degrees C.), preferably ranging from 450 degrees F. to 725 degrees F. (230 degrees C. to 385 degrees C.).

Hydrotreating is used as a step following hydroisomerization dewaxing in the lubricant base oil manufacturing process of this invention. This step, herein called hydrofinishing, is intended to improve the oxidation stability, UV stability, and appearance of the product by removing traces of aromatics, olefins, color bodies, and solvents. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. Clay treating to remove these impurities is an alternative final process step.

Fractionation:

Optionally, the process of this invention may include fractionating of the substantially paraffinic wax feed prior to hydroisomerization dewaxing, or fractionating of the lubricating base oil. The fractionation of the substantially paraffinic wax feed or lubricating base oil into distillate fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600 degrees F. to about 750 degrees F. (about 315 degrees C. to about 399 degrees C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions, into different boiling range cuts. Fractionating the lubricating base oil into different boiling range cuts enables the lubricating base oil manufacturing plant to produce more than one grade, or viscosity, of lubricating base oil.

Solvent Dewaxing:

Solvent dewaxing may be optionally used to remove small amounts of remaining waxy molecules from the lubricating base oil after hydroisomerization dewaxing. Solvent dewaxing is done by dissolving the lubricating base oil in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566 to 570. See also U.S. Pat. Nos. 4,477,333, 3,773,650 and 3,775,288.

Lubricating Base Oil Hydrocarbon Composition:

The lubricating base oils of this invention have greater than 95 weight percent saturates as determined by elution column chromatography, ASTM D 2549-02. Olefins are present in amounts less than detectable by long duration $C^{13}$ Nuclear Magnetic Resonance Spectroscopy (NMR). Molecules with at least one aromatic function are present in amounts less than 0.3 weight percent by HPLC-UV, and confirmed by ASTM D 5292-99 modified to measure low level aromatics. In preferred embodiments molecules with at least aromatic function are present in amounts less than 0.10 weight percent, preferably less than 0.05 weight percent, more preferably less than 0.01 weight percent. Sulfur is present in amounts less than 25 ppm, more preferably less than 1 ppm as determined by ultraviolet fluorescence by ASTM D 5453-00.

Aromatics Measurement by HPLC-UV:

The method used to measure low levels of molecules with at least on aromatic function in the lubricating base oils of this invention uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with naphthenic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and naphthenic substitution on the ring system. These bathochromic shifts are well known to be caused by alkyl-group delocalization of the or $\pi$-electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricating base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8–12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function content in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95–99% of the aromatics in highly saturated lubricating base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A 15-hour duration run on a 400–500 MHz NMR with a 10–12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Cycloparaffin Distribution by FIMS:

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffin function is very low in a lubricating base oil, the additive solubility is low and the elastomer compatibility is poor. Examples of base oils with these properties are polyalphaolefins and Fischer-Tropsch base oils (GTL base oils) with less than about 5% cycloparaffins. To improve these properties in finished lubricants, expensive co-solvents such as esters must often be added. There is achieved by this invention lubricating base oils with a high weight percent of molecules containing monocycloparaffins and a low weight percent of molecules containing multicycloparaffins such that they have high oxidation stability and high viscosity index in addition to good additive solubility and elastomer compatibility.

The distribution of the saturates (n-paraffin, iso-paraffin, and cycloparaffins) in lubricating base oils of this invention is determined by field ionization mass spectroscopy (FIMS). FIMS spectra were obtained on a VG 70VSE mass spectrometer. The samples were introduced via a solid probe, which was heated from about 40° C. to 500° C. at a rate of 50° C. per minute. The mass spectrometer was scanned from m/z 40 to m/z 1000 at a rate of 5 seconds per decade. The acquired mass spectra were summed to generate one "averaged" spectrum. Each spectrum was $C_{13}$ corrected using a software package from PC-MassSpec. FIMS ionization efficiency was evaluated using blends of nearly pure branched paraffins and highly naphthenic, aromatics-free base stock. The ionization efficiencies of iso-paraffins and cycloparaffins in these base oils were essentially the same. Iso-paraffins and cycloparaffins comprise more than 99.9% of the saturates in the lubricating base oils of this invention.

The lubricating base oils of this invention are characterized by FIMS into paraffins and cycloparaffins containing different numbers of rings. Monocycloparaffins contain one ring, dicycloparaffins contain two rings, tricycloparaffins contain three rings, tetracycloparaffins contain four rings, pentacycloparaffins contain five rings, and hexacycloparaffins contain six rings. Cycloparaffins with more than one ring are referred to as multicycloparaffins in this invention.

In one embodiment, the lubricating base oils of this invention have a weight percent of all molecules with at least one cycloparaffin function greater than 10, preferably greater than 15, more preferably greater than 20. They have a ratio of weight percent of molecules containing monocycloparaffins to weight percent of molecules containing multicycloparaffins greater than 15, preferably greater than 50, more preferably greater than 100. The most preferred lubricating base oils of this invention have a weight percent of molecules containing monocycloparaffins greater than 10, and a weight percent of molecules containing multicycloparaffins less than 0.1, or even no molecules containing multicycloparaffins. In this embodiment, the lubricating base oils may have a kinematic viscosity at 100° C. between about 2 cSt and about 20 cSt, preferably between about 2 cSt and about 12 cSt, most preferably between about 3.5 cSt and about 12 cSt.

In another embodiment of this invention there is a relationship between the weight percent of all molecules with at least one cycloparaffin function and the kinematic viscosity of the lubricating base oils of this invention. That is, the higher the kinematic viscosity at 100° C. in cSt the higher the amount of all molecules with at least one cycloparaffin function that are obtained. In a preferred embodiment the lubricating base oils have a weight percent of all molecules with at least cycloparaffin function greater than the kinematic viscosity in cSt multiplied by three, preferably greater than 15, more preferably greater than 20; and a ratio of weight percent of molecules containing monocycloparaffins to weight percent of molecules containing multicycloparaffins greater than 15, preferably greater than 50, more preferably greater than 100. The lubricating base oils have a kinematic viscosity at 100° C. between about 2 cSt and about 20 cSt, preferably between about 2 cSt and about 12 cSt. Examples of these base oils may have a kinematic viscosity at 100° C. of between about 2 cSt and about 3.3 cSt and have a weight percent of all molecules with at least one cycloparaffin function that is very high, but less than 10 weight percent.

The modified ASTM D 5292-99 and HPLC-UV test methods used to measure low level aromatics, and the FIMS test method used to characterize saturates are described in D. C. Kramer, et al., "Influence of Group II & III Base Oil Composition on VI and Oxidation Stability," presented at the 1999 AIChE Spring National Meeting in Houston, Mar. 16, 1999, the contents of which is incorporated herein in its entirety.

Although the wax feeds of this invention are essentially free of olefins, base oil processing techniques can introduce olefins, especially at high temperatures, due to 'cracking' reactions. In the presence of heat or UV light, olefins can polymerize to form higher molecular weight products that can color the base oil or cause sediment. In general, olefins can be removed during the process of this invention by hydrofinishing or by clay treatment.

Base Oil Pour Factor

In preferred embodiments, the lubricating base oils of this invention have a ratio of pour point in degrees Celsius to kinematic viscosity at 100° C. in cSt greater than the Base Oil Pour Factor of said lubricating base oil. The Base Oil Pour Factor is a function of the kinematic viscosity at 100° C. and is calculated by the following equation: Base Oil Pour Factor=7.35×Ln(Kinematic Viscosity at 100° C.)−18, where Ln(Kinematic Viscosity) is the natural logarithm with base "e" of the kinematic viscosity at 100° C. measured in centistokes (cSt). The test method used to measure pour point is ASTM D 5950-02. The pour point is determined in one degree increments. The test method used to measure the kinematic viscosity is ASTM D 445-01. We show a plot of this equation in FIG. 1.

This relationship of pour point and kinematic viscosity in preferred embodiments of this invention also defines the preferred lower limit of pour point in degrees Celsius for each oil viscosity. For preferred examples of the lubricating base oils of this invention, the lower limit of pour point at a given kinematic viscosity at 100° C.=Base Oil Pour Factor×Kinematic Viscosity at 100° C. Thus the lower limit of pour point for a preferred 2.5 cSt lubricating base oil would be −28° C., for a preferred 4.5 cSt lubricating base oil would be −31° C., for a preferred 6.5 cSt lubricating base oil would be −28° C., and for a preferred 10 cSt lubricating base oil would be −11° C. By selecting for moderately low pour points we have oils that are not over-dewaxed that can be produced in high yields. In most cases the pour points of the lubricating base oils of this invention will be between −35° C. and +10° C.

In preferred embodiments, the high ratio of pour point to kinematic viscosity at 100° C. controls the pour point into a range that is moderately low, thus not requiring severe dewaxing. The severe dewaxing required to produce lubricating base oils with high cycloparaffins and very low pour points in the prior art decreased the ratio of monocycloparaffins to multicycloparaffins, and perhaps most importantly reduced the total yield of lubricating base oil and finished lubricant produced.

There is not necessarily a relationship between the Base Oil Pour Factor and desired cycloparaffin composition between base oils made by different manufacturing processes. Each desired property of the lubricating base oil of this invention should be selected for independently until a relationship may be determined for a specific manufacturing process.

The base oils of this invention respond favorably to the addition of conventional pour point depressants. Due to this favorable interaction it is not necessary to over dewax them to very low pour points at a yield disadvantage. With the addition of pour point depressant they may be blended into products meeting severe requirements for good low temperature properties, such as automotive engine oils.

Other Lubricating Base Oil Properties

Viscosity Index:

The viscosity indexes of the lubricating base oils of this invention will be high. In a preferred embodiment they will have viscosity indexes greater than 28×Ln(Kinematic Viscosity at 100° C.)+95. For example a 4.5 cSt oil will have a viscosity index greater than 137, and a 6.5 cSt oil will have a viscosity index greater than 147. In another preferred embodiment the viscosity indexes will be greater than 28×Ln(Kinematic Viscosity at 100° C.)+110. The test method used to measure viscosity index is ASTM D 2270-93(1998).

Aniline Point:

The aniline point of a lubricating base oil is the temperature at which a mixture of aniline and oil separates. ASTM D 611-01b is the method used to measure aniline point. It provides a rough indication of the solvency of the oil for materials which are in contact with the oil, such as additives and elastomers. The lower the aniline point the greater the solvency of the oil. Prior art lubricating base oils with a weight percent of all molecules with at least one aromatic function less than 0.30, made from substantially paraffinic wax feed having less than about 30 ppm total combined nitrogen and sulfur and hydroisomerization dewaxing, tend to have high aniline points and thus poor additive solubility and elastomer compatibility. The higher amounts of all molecules with at least one cycloparaffin function in the lubricating base oils of this invention reduce the aniline point and thus improve the additive solubility and elastomer compatibility. The aniline point of the lubricating base oils of this invention will tend to vary depending on the kinematic viscosity of the lubricating base oil at 100° C. in cSt.

In a preferred embodiment, the aniline point of the lubricating base oils of this invention will be less than a function of the kinematic viscosity at 100° C. Preferably, the function for aniline point is expressed as follows:

$$\text{Aniline Point} \leq 36 \times Ln(\text{Kinematic Viscosity at } 100^\circ \text{ C.}) + 200, \text{ in } ^\circ \text{ F.}$$

Oxidation Stability:

Due to the extremely low aromatics and multicycloparaffins in the lubricating base oils of this invention their oxidation stability exceeds that of most lubricating base oils.

A convenient way to measure the stability of lubricating base oils is by the use of the Oxidator BN Test, as described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability. Traditionally it is considered that the Oxidator BN should be above 7 hours. For the present invention, the Oxidator BN value of the lubricating base oil will be greater than about 30 hours, preferably greater than about 40 hours.

OLOA is an acronym for Oronite Lubricating Oil Additive®, which is a registered trademark of Chevron Oronite.

Noack Volatility:

Another important property of the lubricating base oils of this invention is low Noack volatility. Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) by ASTM D 6375-99a. TGA Noack volatility is used throughout this disclosure unless otherwise stated.

In preferred embodiments, the lubricating base oils of this invention have a Noack volatility less than an amount calculated from the equation: Noack Volatility, Wt %=1000×(Kinematic Viscosity at 100° C.)$^{-2.7}$, preferably less than an amount calculated from the equation: Noack Volatility, Wt %=900×(Kinematic Viscosity at 100° C.)$^{-2.8}$.

CCS Viscosity:

The lubricating base oils of this invention also have excellent viscometric properties under low temperature and high shear, making them very useful in multigrade engine oils. The cold-cranking simulator apparent viscosity (CCS VIS) is a test used to measure the viscometric properties of lubricating base oils under low temperature and high shear. The test method to determine CCS VIS is ASTM D 5293-02. Results are reported in centipoise, cP. CCS VIS has been found to correlate with low temperature engine cranking. Specifications for maximum CCS VIS are defined for automotive engine oils by SAE J300, revised in June 2001. The CCS VIS measured at −35° C. of the lubricating base oils of this invention are low, preferably less than an amount calculated by the equation: CCS VIS (−35° C.), cP=38×(Kinematic Viscosity at 100° C.)$^{3}$, more preferably less than an amount calculated by the equation: CCS VIS (−35° C.), cP=38×(Kinematic Viscosity at 100° C.)$^{2.8}$.

Elastomer Compatibility:

Lubricating base oils come into direct contact with seals, gaskets, and other equipment components during use. Original equipment manufacturers and standards setting organizations set elastomer compatibility specifications for different types of finished lubricants. Examples of elastomer compatibility tests are CEC L-39-T-96, and ASTM D 4289-03. An ASTM standard entitled "Standard Test Method and Suggested Limits of Determining the Compatibility of Elastomer Seals for Industrial Hydraulic Fluid Applications" is currently in development. Elastomer compatibility test procedures involve suspending a rubber specimen of known volume in the lubricating base oil or finished lubricant under fixed conditions of temperature and test duration. This is followed at the end of the test by a second measurement of the volume to determine the percentage swell that has occurred. Additional measurements may be made of the changes in elongation at break and tensile strength. Depending on the rubber type and application, the test temperature may vary significantly. The lubricating base oils of this invention are compatible with a broad number of elastomers, including but not limited to the following: neoprene, nitrile (acrylonitrile butadiene), hydrogenated nitrile, polyacrylate, ethylene-acrylic, silicone, chlor-sulfonated polyethylene, ethylene-propylene copolymers, epichlorhydrin, fluorocarbon, perfluoroether, and PTFE.

Lubricant Additive

The process of this invention for manufacturing of a finished lubricant includes the step of blending the lubricating base oil with at least one lubricant additive. Additives which may be blended with the lubricating base oil to form the finished lubricant composition include those which are intended to improve certain properties of the finished lubricant. Typical additives include, for example, anti-wear additives, EP agents, detergents, dispersants, antioxidants, pour point depressants, Viscosity Index improvers, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fluid-loss additives, colorants, and the like. Typically, the total amount of additive in the finished lubricant is within the range of 0.1 to 30 weight percent. Typically the amount of lubricating base oil of this invention in the finished lubricant is between 10 and 99.9 weight percent, preferably between 25 and 99 weight percent. Lubricant additive suppliers will provide information on effective amounts of their individual additives or additive packages to be blended with lubricating base oils to make finished lubricants. However due to the excellent properties of the lubricating base oils of the invention, less additives than required with lubricating base oils made by other processes may be required to meet the specifications for the finished lubricant.

Viscosity Index improvers are high molecular weight polymers that are added to finished lubricants to provide higher viscosity index. Examples of viscosity index improvers that may be used with the lubricating base oils of this invention are olefin copolymers (OCP), co-polymers of ethylene and propylene, polyalkylacrylates, polyalkylmethacrylates, polyisobutylene, hydrogenated styrene-isoprene copolymers, and hydrogenated styrene-butadienes. Because the lubricating base oils of this invention have very high viscosity indexes, appreciably less or no viscosity index improver is required. The amount of viscosity index improver that may be used in finished lubricants of this invention is generally less than 12 weight percent, preferably less than 8 weight percent, more preferably less than 3 weight percent, and most preferably less than 1 weight percent. Concentrations of viscosity index improvers required with most other base oils are usually between 3 and 25 weight percent. The use of polymeric viscosity index improvers in multigrade engine oils has known drawbacks, including poor shear stability and sensitivity to oxidation. As a result, the viscosity index improvers are degraded in the engine and form engine deposits and permanently reduce the oil viscosity. By using less viscosity index improver a finished lubricant with improved performance in regards to shear stability, oxidation stability, and deposit control may be formulated. Also, because at least one deposit precursor has been minimized, less deposit-control additives are required.

Ester co-solvents are polar esters that act as plasticizers and have a high polarity. They are often required to be added to Group II and Group III base oils that have lower amounts of cycloparaffins and to polyalphaolefins to improve their additive solubility and reduce the tendency of these base oils to shrink and harden elastomers. Unfortunately, esters have affinity for water, and micropitting resistance of the oils that are blended with esters may decrease if they become contaminated with water. Micropitting is surface fatigue occurring in Hertzian contacts, caused by cyclic contact stresses and plastic flow on the asperity scale. Ester co-solvents are also expensive to use and it is preferable to formulate finished lubricants without them.

Because the lubricating base oils of this invention have excellent additive solubility and elastomer compatibility due to their novel composition, finished lubricants may be formulated from them with little or no ester co-solvent. The finished lubricants of this invention may have less than 8 weight percent, preferably less than 3 weight percent, more preferably less than 1 weight percent ester co-solvent.

The high oxidation stability of the lubricating base oils of this invention will require lower amounts of antioxidants be used in the finished lubricants comprising them. The low wear of the lubricating base oils of this invention will require lower amounts of antiwear additives.

The use of additives in formulating finished lubricants is well documented in the literature and well within the ability of one skilled in the art. Therefore, additional explanation should not be necessary in this disclosure.

Finished Lubricant Specifications

The finished lubricants of this invention, for example, may be formulated to meet engine oil service categories API SL/ILSAC GF-3 and ACEA 2002 European Oil Sequences. They may also be formulated to meet the SAE J300, June 2001 specifications for 0W-XX, 5W-XX, 10W-XX, and 15W-XX multigrade engine oils, where XX is 20, 30, 40, 50, or 60.

In addition they may be formulated to meet Chrysler MOPAR® ATF PLUS, ATF+2, ATF+3, ATF+4; GM DEXRON® II, DEXRON® IIE, DEXRON® III(G), 2003 DEXRON® II, DEX-CVT®; Ford MERCON® and MERCON® V; and heavy duty automatic transmission fluid specifications Allison C-4, Allison TES-295, Caterpillar TO-4, ZF TE-ML 14B, and Voith G607. The base oils of this invention may be formulated to meet the most demanding requirements of the 2003 DEXRON® III specification, which includes an increase in the length of the oxidation test by fifty percent, an increase in the number of cycles in the Cycling Test by sixty percent, and an increase in the hours in the Plate Friction Test by fifty percent over the previous DEXRON® III(G) specification.

The lubricating base oils of this invention may be formulated into power steering fluids for automobiles and light trucks. They would meet the requirements of a variety of specifications for power steering fluids used in automotive power steering systems, including DaimlerChrysler MS5931, Ford ESW-M2C128-C, GM 9985010, Navistar TMS 6810, and Volkswagen TL-VW-570-26.

Examples of industrial gear lubricant specifications that finished lubricants formulated with the lubricating base oils of this invention may meet include: AISE 224, AGMA 9005-D94 [16], General Motors LS-2, David Brown ET 33/80, DIN 51517/3, Flenders, and Cincinnati Milacron P-35, P-59, P-63, P-74, P-77, and P-78.

DEXRON® and DEX-CVT® are registered trademarks of General Motors Corporation. MERCON® is a registered trademark of Ford Motor Company. MOPAR® is a registered trademark of Chrysler Corporation.

Specific Finished Lubricant Tests

MRV: Mini-Rotary Viscometer (ASTM D 4684)—The MRV test, which is related to the mechanism of pumpability, is a low shear rate measurement. Slow sample cooling rate is the method's key feature. A sample is pretreated to have a specified thermal history which includes warming, slow cooling, and soaking cycles. The MRV measures an apparent yield stress, which, if greater than a threshold value, indicates a potential air-binding pumping failure problem. Above a certain viscosity (currently defined as 60,000 cP by SAE J 300 June 2001), the oil may be subject to pumpability failure by a mechanism called "flow limited" behavior. An SAE 10W oil, for example, is required to have a maximum viscosity of 60,000 cP at −30° C. with no yield stress. This method also measures an apparent viscosity under shear rates of 1 to 50 $s^{-1}$.

HTHS: High temperature high shear rate viscosity (HTHS) is a measure of a fluid's resistance to flow under conditions resembling highly-loaded journal bearings in fired internal combustion engines, typically 1 million $s^{-1}$ at 150° C. HTHS is a better indication of how an engine operates at high temperature with a given lubricant than the kinematic low shear rate viscosities at 100° C. The HTHS value directly correlates to the oil film thickness in a bearing. SAE J300 June 2001 contains the current specifications for HTHS measured by either ASTM D 4683, ASTM D 4741, or ASTM D 5481. An SAE 20 viscosity grade engine oil, for example, is required to have a maximum HTHS of 2.6 centipoise (cP).

Scanning Brookfield Viscosity: ASTM D 5133-01 is used to measure the low temperature, low shear rate, viscosity/temperature dependence of engine oils. The low temperature, low shear viscometric behavior of an engine oil determines whether the oil will flow to the sump inlet screen, then to the oil pump, then to the sites in the engine requiring lubrication in sufficient quantity to prevent engine damage immediately or ultimately after cold temperature starting. ASTM D 5133, the Scanning Brookfield Viscosity technique, measures the Brookfield viscosity of a sample as it is cooled at a constant rate of 1° C./hour. Like the MRV, ASTM D 5133 is intended to relate to an oil's pumpability at low temperatures. The test reports the gelation point, defined as the temperature at which the sample reaches 30,000 cP. The gelation index is also reported, and is defined as the largest rate of change of viscosity increase from −5° C. to the lowest test temperature. The current API SL/ILSAC GF-3 specifications for passenger car engine oils require a maximum gelation index of 12.

HFRR Wear Test Protocol: The HFRR Wear Test is used to measure the anti-wear performance of finished lubricants. Wear tests were conducted on 1 ml oil samples using a High Frequency Reciprocating Rig [PCS Instruments HFR2] using SAE-AISI 8620 0.25" diameter through-hardened balls [Roughness=0.14 microns Ra; Vickers Hardness=800–870 kg/mm^2] on polished SAE-AISI 8620 flat disks [Roughness=0.06 microns Ra; Vickers Hardness=210–230 HV]. Preferably the finished lubricants of this invention will have an HFRR wear volume with 1 Kg load less than 500,000 cubic microns.

Test conditions involved:

| | |
|---|---|
| Frequency | 20 Hz |
| Load | 100 g, 1 Kg |
| Stroke | 1 mm |
| Temperature | 100° C. |
| Time | 30 minutes |

Because of the extreme hardness differences between the balls and disks, most of the material wear occurred on the disks in the form of a 1 mm long hemispherical wear track. Consequently, anti-wear performances were based solely on the amount of material removed from the disks, and not the balls. Disk wear volume measurements were made after first removing fine wear debris from the surface of the disk with a cotton swab immersed in hexane and then profiling a 1.24 mm×1.64 mm rectangular area of the surface in the vicinity of the wear scar with a MicroXAM-100 3D Surface Profiler [ADE Phase Shift]. A distinction was made between the volume of material removed by adhesion [lubricant related wear] from that displaced by abrasion [plowing] by first leveling the disk's surface profile based on the flat regions immediately adjacent to the wear scar using the MicroXAM's software leveling routine, and then subtracting the volume of metal protruding above the plane of the surface [abrasive] from the void volume extending below the plane of the surface [adhesive]. The net wear scar volumes were reported in cubic microns. The volume precision measurement by this technique is estimated to be ±10 cubic microns. All finished oils were tested in duplicate and the results averaged.

Brookfield Viscosity: ASTM D 2983-03 is used to determine the low-shear-rate viscosity of automotive fluid lubricants at low temperatures. The low-temperature, low-shear-rate viscosity of automatic transmission fluids, gear oils, torque and tractor fluids, and industrial and automotive hydraulic oils are frequently specified by Brookfield viscosities. The GM 2003 DEXRON® III automatic transmission fluid specification requires a maximum Brookfield viscosity at −40° C. of 20,000 cP. The Ford MERCON® V specification requires a Brookfield viscosity between 5,000 and 13,000 cP. Preferably the finished lubricants of this invention will have a Brookfield viscosity at −40° C. of less than 20,000 cP, more preferably between 5,000 and 13,000 CP. In one embodiment they may have a Brookfield viscosity at −40° C. of less than 5,000 cP.

All of the publications, patents and patent applications cited in this application are herein incorporated by reference in their entirety to the same extent as if the disclosure of each individual publication, patent application or patent was specifically and individually indicated to be incorporated by reference in its entirety.

EXAMPLES

The following examples are included to further clarify the invention but are not to be construed as limitations on the scope of the invention.

Fischer-Tropsch Wax

Three samples of hydrotreated Fischer-Tropsch wax made using either a Fe-based or Co-based Fischer-Tropsch synthesis catalyst were analyzed and found to have the properties shown in Table I.

TABLE I

| | Fischer-Tropsch Wax | | |
|---|---|---|---|
| | Fischer-Tropsch Catalyst | | |
| CVX Sample ID | Co-Based WOW9107 | Fe-Based WOW8684 | Co-Based WOW9237 |
| Sulfur, ppm | <6 | | 2 |
| Nitrogen, ppm | 6, 5 | 2, 4, 4, 1, 4, 7 | 1.3 |
| Oxygen by Neutron Activation, Wt % | 0.59 | 0.15 | |
| GC N-Paraffin Analy. | | | |
| Total N Paraffin, Wt % | 84.47 | 92.15 | |
| Avg. Carbon Number | 27.3 | 41.6 | |
| Avg. Molecular Weight | 384.9 | 585.4 | |
| D 6352 SIMDIST TBP (WT %), ° F. | | | |
| T0.5 | 515 | 784 | 450 |
| T5 | 597 | 853 | 571 |
| T10 | 639 | 875 | 621 |
| T20 | 689 | 914 | 683 |
| T30 | 714 | 941 | 713 |
| T40 | 751 | 968 | 752 |
| T50 | 774 | 995 | 788 |

TABLE I-continued

| | Fischer-Tropsch Wax | | |
|---|---|---|---|
| | Fischer-Tropsch Catalyst | | |
| CVX Sample ID | Co-Based WOW9107 | Fe-Based WOW8684 | Co-Based WOW9237 |
| T60 | 807 | 1013 | 823 |
| T70 | 839 | 1031 | 868 |
| T80 | 870 | 1051 | 911 |
| T90 | 911 | 1081 | 970 |
| T95 | 935 | 1107 | 1003 |
| T99.5 | 978 | 1133 | 1067 |
| T90–T10, ° C. | 133 | 97 | 176 |
| Wt % C30+ | 34.69 | 96.9 | 39.78 |
| Wt % C60+ | 0.00 | 0.55 | 0.00 |
| C60+/C30+ | 0.00 | 0.01 | 0.00 |

Lubricating Base Oils

The Fischer-Tropsch wax feeds described in Table I were hydroisomerized over a Pt/SAPO-11 catalyst on an alumina binder. Run conditions were between 652 and 695° F. (344 and 368° C.), 0.6 to 1.0 LHSV, 300 psig or 1000 psig reactor pressure, and a once-through hydrogen rate of between 6 and 7 MSCF/bbl. The reactor effluent passed directly to a second reactor, also at 1000 psig, which contained a Pt/Pd on silica-alumina hydrofinishing catalyst. Conditions in that reactor were a temperature of 450° F. and LHSV of 1.0.

The products boiling above 650° F. were fractionated by atmospheric or vacuum distillation to produce distillate fractions of different viscosity grades. Test data on specific distillate fractions useful as lubricating base oils, and blended finished lubricants of this invention, are shown in the following examples.

Example 1, Example 2, and Example 3

Three lubricating base oils with kinematic viscosities between 3.0 and 5.0 cSt at 100° C. were prepared by hydroisomerization dewaxing Fischer-Tropsch wax as described above. The properties of these two examples are shown in Table II.

TABLE II

| Properties | Example 1 | Example 2 | Example 3 |
|---|---|---|---|
| CVX Sample ID | NGQ9606 | PGQ1118 | NGQ9939 |
| Wax Feed | WOW9107 | WOW9237 | WOW8684 |
| Hydroisomerization Temp, ° F. | 672 | 652 | 682 |
| Hydroisomerization Dewaxing Catalyst | Pt/SAPO-11 | Pt/SAPO-11 | PT/SAPO-11 |
| Reactor Pressure, psig | 1000 | 300 | 1000 |
| Viscosity at 100° C., cSt | 3.94 | 4.397 | 4.524 |
| Viscosity Index | 143 | 158 | 149 |
| FIMS, Wt % of Molecules | | | |
| Paraffins | 89.0 | 79.8 | 89.4 |
| Monocycloparaffins | 11.0 | 21.2 | 10.4 |
| Multicycloparaffins | 0.0 | 0.0 | 0.2 |
| Total | 100.0 | 100.0 | 100.0 |
| Pour Point, ° C. | −19 | −31 | −17 |
| Cloud Point, ° C. | −9 | +3 | −10 |
| Ratio of Mono/Multicycloparaffins | >100 | >100 | 52 |
| Ratio of Pour Point/Vis100 | −4.82 | −7.05 | −3.76 |
| Base Oil Pour Factor | −7.92 | −7.12 | −6.91 |

TABLE II-continued

| Properties | Example 1 | Example 2 | Example 3 |
|---|---|---|---|
| Oxidator BN, Hours | | 26.0 | 34.92 |
| Aniline Point, D 611, ° F. | | | 253.2 |
| Noack Volatility, Wt % | 17.76 | | 12.53 |
| CCS Viscosity −35 C, cP | 1611 | | 2090 |

Example 4 and Example 5

Two lubricating base oils with kinematic viscosities between 6.0 and 7.0 cSt at 100° C. were prepared by hydroisomerization dewaxing Fischer-Tropsch wax as described above. The properties of these two examples are shown in Table III.

TABLE III

| Properties | Example 4 | Example 5 |
|---|---|---|
| CVX Sample ID | NGQ9941 | NGQ9988 |
| Wax Feed | WOW8684 | WOW8684 |
| Hydroisomerization Temp, ° F. | 690 | 681 |
| Hydroisomerization Dewaxing Catalyst | Pt/SAPO-11 | Pt/SAPO-11 |
| Reactor Pressure, psig | 1000 | 1000 |
| Viscosity at 100° C., cSt | 6.297 | 6.295 |
| Viscosity Index | 153 | 154 |
| FIMS, Wt % of Molecules | | |
| Paraffins | 82.5 | 76.8 |
| Monocycloparaffins | 17.5 | 22.1 |
| Multicycloparaffins | 0.0 | 1.1 |
| Total | 100.0 | 100.0 |
| API Gravity | 40.2 | 40.2 |
| Pour Point, ° C. | −23 | −14 |
| Cloud Point, ° C. | −6 | −6 |
| Ratio of Mono/Multicycloparaffins | >100 | 20.1 |
| Ratio of Pour Point/Vis100 | −3.65 | −2.22 |
| Base Oil Pour Factor | −4.48 | −4.48 |
| Aniline Point, D611, ° F. | | 263 |
| Noack Volatility, Wt % | 2.8 | 3.19 |
| CCS Vis −35 C, cP | 4868 | 5002 |

Example 6, Example 7, Example 8, Example 9, Example 10, Example 11, and Example 12

Seven engine oils of six different viscosity grades were blended using three of the lubricating base oils of this invention, Example 2, Example 4, and Example 5. They were blended with one of three commercially available passenger car DI additive packages, an OCP viscosity index improver, and a polymethacrylate pour point depressant. Notably, no viscosity index improver was added to the 0W-XX, 5W-XX, and 10W-30 grade samples. None of the examples had ester co-solvent added. Examples 9 and 10 included another GTL base oil, Chevron GTL Base Oil 9.8. Chevron GTL Base Oil 9.8 had a kinematic viscosity at 100° C. of 9.83 cSt, a viscosity index of 163, a pour point of −12° C., a weight percent of total cycloparaffins of 18.7, and a ratio of monocycloparaffins to multicycloparaffins of 7.1. Three of the engine oil samples, Example 7, Example 11, and Example 12, included conventional Group II base oil. The conventional Group II base oils used were Chevron 220R and Chevron 600R. The amounts of each of the components in these engine oils, their viscometrics, and other measured properties are shown in Table IV.

TABLE IV

| | | Example 6 | Example 7 | Example 8 | Example 9 | Example 10 | Example 11 | Example 12 |
|---|---|---|---|---|---|---|---|---|
| | | SAE Grade | | | | | | |
| | | 0W-20 | 0W-20 | 5W-20 | 5W-30 | 10W-30 | 10W-50 | 15W-50 |
| | | CVX Sample ID | | | | | | |
| | | BOB01046 | ENG03706 | | | | BOB01105 | BOB01107 |
| Components, Wt % | | | | | | | | |
| Example 2 | NGQ9608 | 86.30 | 57.86 | | | | | |
| Example 4 | NGQ9998 | | | | | | 47.67 | 31.78 |
| Example 5 | NGQ9988 | | | 88.7 | 79.83 | 26.61 | | |
| Chevron GTL Base Oil 9.8 | NGQ9938 | | | | 8.87 | 62.09 | | |
| Chevron 220R | NGQ9610 | | 31.49 | | | | | |
| Chevron 600R | WOW8775 | | | | | | 31.78 | 47.67 |
| PCMO DI Pkg. #1 | | | 10.35 | | | | 10.35 | 10.35 |
| OCP VI Improver | | | | | | | 10.00 | 10.00 |
| PPD | | 0.3 | 0.3 | | | | 0.2 | 0.2 |
| PCMO DI Pkg. #2 | | 13.40 | | | | | | |
| PCMO DI Pkg. #3 | | | | 11.3 | 11.3 | 11.3 | | |
| TOTAL | | 100.00 | 100.00 | 100.00 | 100.00 | 100.00 | 100.00 | 100.00 |
| Lubricating Base Oil Viscometrics | | | | | | | | |
| | Viscosity @ 40° C., cSt | 19.14 | | | | | 47.78 | 61.28 |
| | Viscosity @ 100° C., cSt | 4.415 | | | | | 7.846 | 8.955 |
| | Viscosity Index | 147 | | | | | 133 | 122 |
| Blend Analysis | | | | | | | | |
| | Viscosity @ 40° C., cSt | 30.69 | | | | | 118.5 | 145.1 |
| | Viscosity @ 100° C., cSt | 6.366 | 6.43 | | | | 17.05 | 19.07 |
| | Viscosity Index | 165 | 149 | | | | 157 | 149 |
| | CCS @ −35° C., cP | 3,953 | 5,509 | 7,870 | 9,135 | | | |
| | CCS @ −30° C., cP | 2,254 | | 4,285 | 4,885 | 10,730 | | |
| | CCS @ −25° C., cP | | | 2,563 | 2,873 | 5,701 | 5,602 | 9,362 |
| | TGA Noack, wt. % loss | 11.00 | | 3.1 | 2.9 | 2.0 | 6.24 | 6.31 |
| | HTHS, cP | 2.20 | 2.16 | | | | | |
| | MRV @−40° C., cP | 12,202 | 18,588 | | | | | |
| | MRV @−30° C., cP | | | | | | 29,253 | 51,432 |
| | Yield Stress | No | No | | | | No | No |
| | Scanning Brookfield, Gelation Index | 5.6 | | | | | | |
| | Gelation Temperature, ° C. | −25 | | | | | −32 | −30 |
| | Pour Point, ° C. | −43 | | | | | | |
| | HFRR Wear Vol. (100 g load), microns$^3$ | | 63,200 | | | | | |
| | HFRR Wear Vol. (1 Kg load), microns$^3$ | | 463,000 | | | | | |

Note that all of these engine oils had properties meeting the requirements of SAE J300 June'01 and/or API SL/IL-SAC GF-3. Example 7, which was tested for HFRR wear gave very low wear volumes at both 100 g and 1 Kg loads. The additive solubility in all of these oils was excellent, demonstrating that the high levels of monocycloparaffins in the base oils gave good additive solubility without addition of ester co-solvent. It was notable that although the lubricating base oils used to make these engine oils did not have extremely low pour points, they were blended into multi-grade engine oils meeting strict engine oil low temperature properties, including CCS viscosity, MRV, and scanning Brookfield gelation index and gelation temperatures. The high viscosity indexes of the lubricating base oils allowed for great flexibility in blending a wide variety of multigrade engine oil grades. Most of the examples were blended without any viscosity index improver.

Example 13, Example 14, and Example 15

One of the lubricating base oils of this invention, Example 3, was tested for Brookfield viscosity by ASTM D 2983 at −40° C., either neat or blended with one or more pour point depressants. The results of these analyses are summarized in Table V.

TABLE V

| | | Example 3 | Example 13 | Example 14 | Example 15 |
|---|---|---|---|---|---|
| Components, Wt % | | | | | |
| Example 3 | NGQ9939 | 100 | 99.8 | 90 | 89.9 |
| PPD #1 | | | 0.2 | | 0.1 |
| PPD #2 | | | | 10 | 10 |
| TOTAL | | 100.0 | 100.0 | 100.0 | 100.0 |
| Lubricating Base Oil Viscometrics | | | | | |
| | Viscosity @ 40° C., cSt | 19.75 | | | |
| | Viscosity @ 100° C., cSt | 4.52 | | | |
| | Viscosity Index | 149 | | | |
| Blend Viscometrics | Brookfield Vis @ −40° C., cP | >1 million | 12,600 | 950,000 | 13,800 |

The Brookfield viscosity of two of the example blends, Examples 13 and 15, were below 20,000 cP, and the Brookfield viscosity of Example 13 was below 13,000 cP. The GM 2003 DEXRON® III maximum Brookfield viscosity is 20,000 cP. The Ford MERCON® V maximum Brookfield viscosity is 13,000 cP. These examples demonstrate that the lubricating base oils of this invention respond well to pour point depressants, and may successfully be used to make high quality automatic transmission fluids. Lower viscosity lubricating base oils of this invention, or blends containing them, would have even better Brookfield viscosity performance.

Example 16 and Comparative Example 17

Additive solvency and storage stability of the finished lubricants of this invention compared with the solvency of finished lubricants blended with conventional Group III base oil was tested. Example 16 was prepared by blending 11.3 wt % GF-4 engine oil additive package and 1 wt % viscosity index improver into Example 3. Comparative Example 17 was prepared by blending 11.3 wt % of a typical current PCMO additive package into Chevron conventional Group III base oil. Additive solvencies were observed over a 4 week period. The storage conditions were room temperature (approximately 25° C.), 65° C., 0° C., or −18° C. Some of the samples were stored in contact with steel. The additive solvency observations were made at both the test temperatures, and (after warming, when required) at room temperature. The results of the analyses are shown in Table VI.

TABLE VI

| Components, Wt % | Example 16 | Comparative Example 17 |
|---|---|---|
| Example 3 | 87.7 | |
| Chevron Conventional Group III, 4 cSt base oil | | 88.7 |
| GF-4 Additive Pkg. | 11.3 | |
| Typical Current PCMO Additive Pkg. | | 11.3 |
| Viscosity Index Improver | 1.0 | |
| TOTAL | 100.0 | 100.0 |
| Week: 1 | | |
| RT With Steel | C | C + T |
| 65 C. With Steel | C | C |
| 0 C. at 0 C. | C | C |
| 0 C. at RT | C | C + T |
| −18 C. at −18 C. | N | SLZ |
| −18 C. at RT | C | C |
| Week: 2 | | |
| RT With Steel | C | C + T |
| 65 C. With Steel | C | C |
| 0 C. at 0 C. | C | C |
| 0 C. at RT | C | C + T |
| −18 C. at −18 C. | N | SLZ |
| −18 C. at RT | C | C + T |
| Week: 3 | | |
| RT With Steel | C | C + T |
| 65 C. With Steel | C | C |
| 0 C. at 0 C. | C | C |
| 0 C. at RT | C | C + T |
| −18 C. at −18 C. | N | SLZ |
| −18 C. at RT | C | C + T |
| Week: 4 | | |
| RT With Steel | C | C + T |
| 65 C. With Steel | C | C |
| 0 C. at 0 C. | C | C |
| 0 C. at RT | C | C + T |
| −18 C. at −18 C. | N | SLZ |
| −18 C. at RT | C | C + T |

Code
C = clear
T = trace of haze
Z = haze
N = not observed
SLZ = slight haze

These results clearly demonstrate the excellent additive solubility and storage stability of the finished lubricants made with the lubricating base oils of this invention. The additive solubility was better than with conventional Group III base oil of a similar viscosity. Conventional Group III base oils have a relatively high amount of cycloparaffins, but contain significant levels of multicycloparaffins, unlike the lubricating base oils used in the finished lubricants of this invention.

Comparative Example 18, Example 19, Comparative Example 20

Three different passenger car engine oil (PCMOs) blends were prepared. Comparative Example 18 was blended using conventional Group II base oils. Example 19 was blended with GTL base oils, one of which was the lubricating base oil of this invention (Example 5). Comparative Example 20 was blended with Conventional Group I base oils. Chevron GTL Base Oil 14 had a kinematic viscosity at 100° C. of 14.62 cSt, a viscosity index of 160, a pour point of −1° C., a weight percent multicycloparaffins of 24.1, and a ratio of monocycloparaffins to multicycloparaffins of 11. All of the engine oil blends contained the same PCMO DI additive package and an OCP viscosity index improver. None of the blends contained any ester co-solvent. The blends were tested according to the CEC L-39-T-96 test method, using three different elastomers: fluorocarbon, polyacrylate, and nitrile. Elastomer hardness change, tensile strength change, and elongation change were measured. The results of the elastomer compatibility tests are shown in Table VII.

TABLE VII

| Components, Wt % | | Comparative Example 18 | Example 19 | Comparative Example 20 |
|---|---|---|---|---|
| CVX Sample ID | | BOB01246 | BOB01247 | BOB01248 |
| Chevron 220R | | 65.62 | | |
| Chevron 600R | | 11.59 | | |
| Example 5 | | | 66.40 | |
| Chevron GTL Base Oil 14 | | | 10.81 | |
| ExxonMobil Americas CORE ™ 150 | | | | 48.64 |
| Exxon Mobil Americas CORE ™ 600 | | | | 28.57 |
| PAO 8 cSt | | | | |
| PCMO DI Package | | | 15.10 | |
| OCP VI Improver | | | 7.49 | |
| Pour Point Depressant | | | 0.20 | |
| TOTAL | | 100.00 | 100.00 | 100.00 |
| | Viscosity at 40° C. | 122.8 | 87.82 | 124.5 |
| | Viscosity at 100° C. | 15.84 | 14.45 | 15.97 |
| | VI | 137 | 172 | 136 |
| | CCS VIS AT −15° C. | 3,784 | 1,578 | 4,007 |
| RE1 (02/02), Fluorocarbon, 150° F. | Volume Change, % (Limits −1 to 5%) | 0.47 | 0.45 | 0.60 |
| | | 0.32 | 0.39 | 0.51 |
| | | 0.26 | 0.35 | 0.38 |
| | Average | 0.45 | 0.40 | 0.50 |
| | Points | 0 | 1 | 0 |
| | Hardness | −1 | 1 | 0 |
| | Change (Limits −1 to 5) | 0 | 0 | 1 |
| | Average | 0 | 1 | 0 |
| | Tensile | −26.4 | −27.1 | −30.0 |
| | Strength | 26.8 | −27.9 | −30.0 |
| | Change, % (Limits −50 to 10%) | −22.6 | −29.2 | −31.0 |
| | Average | −25.2 | −28.1 | −31.4 |
| | Elongation | −44.8 | −44.6 | −45.3 |
| | Change, % | −46 | −45.3 | −44.8 |
| | (Limits −60 to 10%) | −43.6 | −46.5 | −43.7 |
| | Average | −44.8 | −45.5 | −44.6 |
| RE2 (08/01), Polyacrylate, 150° F. | Volume Change, % (Limits −7 to 5%) | 1.26 | 0.15 | 2.12 |
| | | 1.13 | 0.17 | 2.20 |
| | | 1.14 | 0.07 | 1.89 |
| | Average | 1.18 | 0.13 | 2.07 |
| | Points | 3 | 5 | 3 |
| | Hardness | 4 | 4 | 4 |
| | Change (Limits −5 to 8) | 4 | 5 | 4 |
| | Average | 4 | 5 | 4 |
| | Tensile | −9.3 | −12.9 | −8.4 |
| | Strength | −12.7 | −11.5 | −11.6 |
| | Change, % (Limits −15 to 18%) | .12.8 | −15.4 | −8.4 |
| | Average | −11.6 | −13.3 | −9.5 |
| | Elongation | −32.5 | −36.3 | −32.2 |

TABLE VII-continued

| Components, Wt % | | Comparative Example 18 | Example 19 | Comparative Example 20 |
|---|---|---|---|---|
| | Change, % | −39.6 | −37.8 | −35.8 |
| | (Limits −35 to 10%) | −38.6 | −38.4 | −35.5 |
| | Average | −36.9 | −37.5 | −34.5 |
| RE4 (02/02), Nitrile, 100° F. | Volume Change, % (Limits −5 to 5%) | | 0.56 | 2.49 |
| | | | 0.54 | 2.56 |
| | | | 0.30 | 2.51 |
| | Average | | 0.47 | 2.52 |
| | Points | | 0 | −3 |
| | Hardness | | 0 | −3 |
| | Change (Limits −5 to 5) | | 0 | −3 |
| | Average | | 0 | −3 |
| | Tensile | | −5.0 | 1.6 |
| | Strength | | −2.5 | 0.5 |
| | Change, % (Limits −20 to 10%) | | −0.9 | 1.7 |
| | Average | | −2.2 | 1.2 |
| | Elongation | | −33.50 | −29.30 |
| | Change, % | | −37.40 | −31.50 |
| | (Limits −50 to 10%) | | −37.00 | −27.20 |
| | Average | | −36.00 | −29.30 |

These results show that, except for elongation change of polyacrylate, the Example 19 engine oil was fully compatible with fluorocarbon, polyacrylate, and nitrile elastomers. Neither Comparative Example 18 blended with conventional Group II base oils nor Example 19 met the limits for elongation change for polyacrylate. They would both require approximately the same small amount of ester co-solvent to bring the elongation change of polyacrylate to within −35 to 10%. Note the much higher viscosity index and lower CCS viscosity of the engine oil of this invention, Example 19, compared to the comparative examples blended with conventional commercial base oils.

Example 21 and Example 22

Two blends of the automatic transmission fluids of this invention were blended using the lubricating base oil Example 1. Neither blend contained any ester co-solvent. Example 21 was blended with a second GTL base oil, Chevron GTL Base Oil 2.5, and a commercially available DEXRON® III ATF additive package. Chevron GTL Base Oil 2.5 had a kinematic viscosity at 100° C. of 2.583 cSt, a viscosity index of 133, a pour point of −30° C., 7.0 weight percent monocycloparaffins, and no multicycloparaffins. Example 22 was blended with a heavy duty ATF additive package, polymethacrylate (PMA) viscosity index improver, and a pour point depressant. The test results on these blends are shown in Table VIII.

TABLE VIII

| | Example 21 | Example 22 |
|---|---|---|
| CVX Sample ID | LUB01282 | LUB01285 |
| Components, Wt % | | |
| Example 1 | 89.70 | 57.30 |
| Chevron GTL Base Oil 2.5 | | 21.55 |

TABLE VIII-continued

| | Example 21 | Example 22 |
|---|---|---|
| DEXRON ® III ATF Additive Pkg. | 10.30 | |
| Heavy Duty ATF Additive Pkg. | | 8.80 |
| PMA VI Improver | | 12.15 |
| Pour Point Depressant | | 0.20 |
| Total Weight % | 100.00 | 100.00 |
| Base oil Viscosity, cSt, 100° C. | 3.94 | 3.500 |
| Finished Product Tests | | |
| Viscosity, cSt, 40° C. | 26.05 | 32.51 |
| Viscosity, cSt, 100° C. | 6.433 | 7.502 |
| Viscosity Index | 216 | 209 |
| Brookfield Viscosity, cP @ −40° C. | 4,940 | 7,450 |

These blends demonstrate the excellent viscometrics of the automatic transmission fluids made using the process of this invention. Even though Example 1 had a moderate pour point of −19° C. it was easily blended into ATFs with excellent viscometrics. Example 21 met the viscometric requirements of GM 2003 DEXRON® III and Ford MERCON® V specifications. Example 21 had a Brookfield viscosity less than 5,000 cP, which is especially desirable. Example 22 met the viscometric requirements of GM 2003 DEXRON® III and Ford MERCON® specifications, as well as the heavy duty ATF specifications of Allison C-4 and Caterpillar TO-4 (10W). Both of these finished lubricants made with the lubricating base oil Example 1 would have excellent elastomer compatibility, superior oxidation stability, low Noack volatility, and low wear.

What is claimed is:

1. A process for manufacturing a finished lubricant, comprising the steps of:

a. performing a Fischer-Tropsch synthesis on syngas to provide a product stream;

b. isolating from said product stream a substantially paraffinic wax feed having:

i. less than about 30 ppm total combined nitrogen and sulfur;

ii. less than about 1 weight percent oxygen;

iii. a weight ratio of molecules having at least 60 or more carbon atoms and molecules having at least 30 carbon atoms less than 0.10;

c. dewaxing said substantially paraffinic wax feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), whereby an isomerized oil is produced;

d. hydrofinishing said isomerized oil, whereby a lubricating base oil is produced having:

i. a weight percent of all molecules with at least one aromatic function less than 0.30;

ii. a weight percent of all molecules with at least one cycloparaffin function greater than 10;

iii. a ratio of weight percent of molecules containing monocycloparaffins to weight percent of molecules containing multicycloparaffins greater than 20;

iv. a viscosity index greater than an amount calculated by the equation: VI=28×Ln(Kinematic Viscosity at 100° C.) +95; and e. blending the lubricating base oil with at least one lubricant additive.

2. The process of claim 1, wherein said substantially paraffinic wax feed has a weight ratio of molecules having at least 60 or more carbon atoms and molecules having at least 30 carbon atoms less than 0.05, and a T90 boiling point between 660° F. (349 ° C.) and 1200° F. (649° C.).

3. The process of claim 1, wherein said finished lubricant has less than 1 weight percent ester co-solvent.

4. The process of claim 1, wherein said finished lubricant has less than 8 weight percent viscosity index improver.

5. The process of claim 1, wherein the finished lubricant meets the specifications of one of the SAE J300 June 2001 viscosity grades for multigrade engine oils: 0W-XX, 5W-XX, 10W-XX, and 15W-XX, where XX is 20, 30, 40, 50, or 60.

6. The process of claim 1, wherein the finished lubricant meets the requirements of one or more of the following automatic transmission fluid specifications: DEXRON® II, DEXRON® IIE, DEXRON® III(G), 2003 DEXRON® III, MERCON®, MERCON® V, MOPAR® ATF PLUS, ATF+2, ATF+3, ATF+4, and DEX-CVT®.

7. The process of claim 1, wherein said finished lubricant meets the requirements for one or more of the following heavy duty transmission fluid specifications: Allison C-4, Allison TES-295, Caterpillar TO-4, ZF TE-ML 14B, and Voith G607.

8. The process of claim 1, wherein said finished lubricant meets the requirements for one or more of the following power steering fluid specifications: DaimlerChrysler MS5931, Ford ESW-M2C128-C, GM 9985010, Navistar TMS 6810, and Volkswagen TL-VW-570-26.

9. The process of claim 1, further comprising blending the lubricating base oil with an additional base oil selected from the group consisting of conventional Group I base oils, conventional Group II base oils, conventional Group III base oils, other GTL base oils, and mixtures thereof.

10. The process of claim 1, wherein said finished lubricant has an HFRR wear volume with 1 Kg load less than 500,000 cubic microns.

11. A process for manufacturing a finished lubricant, comprising the steps of:

a. performing a Fischer-Tropsch synthesis on syngas to provide a product stream;

b. isolating from said product stream a substantially paraffinic wax feed having less than about 30 ppm total combined nitrogen and sulfur, less than about 1 weight percent oxygen, and a weight ratio of molecules having at least 60 or more carbon atoms and molecules having at least 30 carbon atoms less than 0.10;

c. dewaxing said substantially paraffinic wax feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), whereby an isomerized oil is produced;

d. hydrofinishing said isomerized oil, whereby a lubricating base oil is produced having:

i. a weight percent of all molecules with at least one aromatic function less than 0.30;

ii. a weight percent of all molecules with at least one cycloparaffin function greater than the kinematic viscosity at 100° C. multiplied by three;

iii. a ratio of weight percent molecules containing monocycloparaffins to weight percent of molecules containing multicycloparaffins greater than 20;

iv. a viscosity index greater than an amount calculated by the equation VI=28×Ln(Kinematic Viscosity at 100° C.)+95; and e. blending the lubricating base oil with at least one lubricant additive.

12. The process of claim 1 or claim 11, wherein the lubricating base oil has a ratio of pour point in degrees Celsius to kinematic viscosity at 100° C. in cSt greater than the Base Oil Pour Factor as calculated by the following equation: Base Oil Pour Factor=7.35×Ln(Kinematic Viscosity at 100° C.)−18.

13. A finished lubricant comprising:

a. a lubricating base oil made from Fischer-Tropsch wax, having:

i. a weight percent of all molecules with at least one aromatic function less than 0.30;

ii. a weight percent of all molecules with at least one cycloparaffin function greater than 10;

iii. a ratio of weight percent of molecules containing monocycloparaffins to weight percent of molecules containing multicycloparaffins greater than 20;

iv. a viscosity index greater than an amount calculated by the equation: VI=28×Ln(Kinematic Viscosity at 100° C.) +95; and b. at least one lubricant additive.

14. The finished lubricant of claim 13, wherein the lubricating base oil has a ratio of pour point in degrees Celsius to kinematic viscosity at 100° C. in cSt greater than the Base Oil Pour Factor as calculated by the following equation: Base Oil Pour Factor=7.35×Ln(Kinematic Viscosity at 100° C.)−18.

15. The finished lubricant of claim 13, wherein the amount of the lubricating base oil is between 10 and 99.9 weight percent and the amount of lubricant additive is between 0.1 and 30 weight percent.

16. The finished lubricant of claim 13, having less than 1 weight percent ester co-solvent.

17. The finished lubricant of claim 13, having less than 8 weight percent viscosity index improver.

18. The finished lubricant of claim 13 that is compatible with one or more elastomers selected from the group consisting of neoprene, nitrile, hydrogenated nitrile, polyacrylate, ethylene-acrylic, silicone, chlor-sulfonated polyethylene, ethylene-propylene copolymers, epichlorhydrin, fluorocarbon, perfluoroether, and PTFE.

19. The finished lubricant of claim 13, wherein it meets the specifications of one of the SAE J300 June 2001 viscosity grades for multigrade engine oils: 0W-XX, 5W-XX, 10W-XX, and 15W-XX, where XX is 20, 30, 40, 50, or 60.

20. The finished lubricant of claim 13, wherein it meets the requirements of one or more of the following automatic transmission fluid specifications: DEXRON® II, DEXRON® IIE DEXRON® III(G), 2003 DEXRON® III, MERCON®, MERCON® V, MOPAR® ATF PLUS, ATF+2, ATF+3, ATF+4, and DEX-CVT®.

21. The finished lubricant of claim 13, wherein it meets the requirements for one or more of the following heavy duty transmission fluid specifications: Allison C-4, Allison TES-295, Caterpillar TO-4, ZF TE-ML 14B, and Voith G607.

22. The finished lubricant of claim 13, wherein it meets the requirements for one or more of the following power steering fluid specifications: DaimlerChrysler MS5931, Ford ESW-M2C128-C, GM 9985010, Navistar TMS 6810, and Volkswagen TL-VW-570-26.

23. The finished lubricant of claim 13, further comprising an additional base oil selected from the group consisting of conventional Group I base oils, conventional Group II base oils, conventional Group III base oils, other GTL base oils, and mixtures thereof.

24. The finished lubricant of claim 13, having an HFRR wear volume with 1 Kg load less than 500,000 cubic microns.

25. The finished lubricant of claim 13, having a Brookfield viscosity at −40° C. of less than 20,000 cP.

26. The finished lubricant of claim 25, having a Brookfield viscosity at −40° C. between 5,000 and 13,000 cP.

27. The finished lubricant of claim 13, having a Brookfield viscosity at −40° C. of less than 5,000 cP.

28. A finished lubricant comprising:

a. a lubricating base oil made from Fischer-Tropsch wax, having:

i. a weight percent of all molecules with at least one aromatic function less than 0.30;

ii. a weight percent of all molecules with at least one cycloparaffin function greater than the kinematic viscosity at 100° C. multiplied by three;

iii. a ratio of weight percent of molecules containing monocycloparaffins to weight percent of molecules containing multicycloparaffins greater than 20;

iv. a viscosity index greater than an amount calculated by the equation: VI=28×Ln(Kinematic Viscosity at 100° C.) +95; and b. at least one lubricant additive.

29. The finished lubricant of claim 28, wherein the lubricating base oil has a ratio of pour point in degrees Celsius to kinematic viscosity at 100° C. in cSt greater than the Base Oil Pour Factor as calculated by the following equation: Base Oil Pour Factor=7.35×Ln(Kinematic Viscosity at 100° C.)−18.

30. A finished lubricant made by the process comprising the steps of:

a. performing a Fischer-Tropsch synthesis on syngas to provide a product stream;

b. isolating from said product stream a substantially paraffinic wax feed having less than about 30 ppm total combined nitrogen and sulfur, less than about 1 weight percent oxygen, and a weight ratio of molecules having at least 60 or more carbon atoms and molecules having at least 30 carbon atoms less than 0.10;

c. dewaxing said substantially paraffinic wax feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), whereby an isomerized oil is produced;

d. hydrofinishing said isomerized oil, whereby a lubricating base oil is produced having a viscosity index greater than an amount defined by the equation: VI=28×Ln(Kinematic Viscosity at 100° C.)+95; and e. blending the lubricating base oil with at least one lubricant additive.

* * * * *